US006441720B1

(12) United States Patent
Kawashima

(10) Patent No.: US 6,441,720 B1
(45) Date of Patent: Aug. 27, 2002

(54) MESSAGE TRANSMISSION TO EXTERNAL UNIT IN RADIO APPARATUS

(75) Inventor: Shinichi Kawashima, Shizuoka (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/291,943

(22) Filed: Apr. 15, 1999

(30) Foreign Application Priority Data

Apr. 27, 1998 (JP) ..... 10-116485

(51) Int. Cl.[7] ..... G08B 5/22

(52) U.S. Cl. ..... 340/7.52; 340/7.2; 340/7.43; 340/7.51; 340/7.54; 340/7.55; 340/7.6; 455/412; 455/186.1

(58) Field of Search ..... 340/7.52, 7.2, 340/7.43, 7.51, 7.54, 7.55, 7.6; 455/412, 186.1, 403

(56) References Cited

U.S. PATENT DOCUMENTS 6,363,246 B1 * 3/2002 Williams et al. ..... 455/403

FOREIGN PATENT DOCUMENTS

| | | |
|---|---|---|
| JP | 4-57417 | 2/1992 |
| JP | 6-13958 | 1/1994 |
| JP | 6-53887 | 2/1994 |
| JP | 6-152501 | 5/1994 |

* cited by examiner

*Primary Examiner*—Brian Zimmerman
*Assistant Examiner*—Yves Dalencourt
(74) *Attorney, Agent, or Firm*—Whitham, Curtis & Christofferson, P.C.

(57) ABSTRACT

A selective call radio receiver with an external connection function, includes a connection section, a normal message storage section, a transfer message storage section and a control section. The connection section is connected with an external unit. The normal message storage section stores normal messages and the transfer message storage section stores transfer messages. The control section classifies a reception message into the normal message and the transfer message based on a header data of the reception message to store in one of the normal message storage section and the transfer message storage section in accordance with the classification. Also, the control section transfers the transfer messages from the transfer message storage section to the external unit through the connection section in response to a transfer instruction.

18 Claims, 16 Drawing Sheets

Fig. 7

| $R_1$ | $R_2$ | $R_3$ | $R_4$ | $R_5$ | $R_6$ | $R_7$ | | $R_j$ |
|---|---|---|---|---|---|---|---|---|
| 1 | 1 | 1 | 1 | 0 | 0 | 0 | ------ | 0 |

103

| | |
|---|---|
| $R_1$ | OPEN ELECTRONICS PARTS EXHIBITION |
| $R_2$ | AT THE 3rd MEETING ROOM FROM 3:00 TODAY |
| $R_3$ | PLEASE CALL ME. 03-1234-5678 |
| $R_4$ | MEET IN SHIBUYA AT 5:00 (NAME) |
| | |
| $R_j$ | |

104

| $T_1$ | $T_2$ | $T_3$ | $T_4$ | $T_5$ | $T_6$ | $T_7$ | | $T_k$ |
|---|---|---|---|---|---|---|---|---|
| 1 | 1 | 1 | | | | | ------ | |

105

| | |
|---|---|
| $T_1$ | OPEN SKI JUMP OF NAGANO OLYMPIC |
| $T_2$ | IN HAKUBA FROM 29-TH DAY. |
| $T_3$ | HARADA AND FUNAKI BECOME GOOD CONDITION. |
| $T_4$ | |
| | |
| $T_k$ | |

106

MESSAGE TRANSMISSION TO EXTERNAL UNIT IN RADIO APPARATUS

BACKGROUND OF THE INVENTION

1. Field of the Invention

The present invention relates to a selective call radio receiver having an external connection function and a method for transmitting its message. More particularly, the present invention relates to a technique of transmitting a received message to an external apparatus.

2. Description of the Related Art

Conventionally, a selective call radio receiver having an external connection function is well known which can be connected through an external terminal to an external apparatus, for example, a personal computer. This selective call radio receiver having the external connection function can once store a received message in a message memory and then transfer the message stored in this message memory to the personal computer. The personal computer can receive the message and display the message on a display or store the message in a memory as a file. Moreover, the personal computer can send a predetermined command to the selective call radio receiver having the external connection function to thereby erase the message stored in the selective call radio receiver having the external connection function.

However, the conventional selective call radio receiver having the external connection function has the following problems. That is, if an amount of messages stored in the message memory exceeds a certain value, the message are automatically discarded in order from the message of the oldest reception time. Thus, there may be a case that the message is discarded before a user read it. Moreover, there may be a case that an old message to be transferred is discarded, if a new message is received before the message stored in the message memory is transferred to the personal computer.

As a technique with regard to such a selective call radio receiver, for example, "Pocket Bell Information Transferring Method" is disclosed in Japanese Laid Open Patent Application (JP-A-Heisei 4-57417). In this pocket bell information transmitting method, call information from a requester is transmitted to a receiver of a subscriber of a pocket bell system together with special information such as emergency information. The information received by the receiver is transferred to an external personal computer and then processed by the personal computer. However, a technique of preventing a message from being discarded when the messages received by the receiver exceeds a predetermined amount is not disclosed in Japanese Laid Open Patent Application (JP-A-Heisei 4-57417).

Also, "Telephone Apparatus" is disclosed in Japanese Laid Open Patent Application (JP-A-Heisei 6-13958). In this reference, when a message is received by a pager, a telephone call can be issued to a counter party with a simple operation without using a memo and the like, in accordance with this received message. Also, a telephone number or a message can be transmitted to an external equipment using a line. However, this technique disclosed in Japanese Laid Open Patent Application (JP-A-Heisei 6-13958) can not prevent the message from being discarded when the message received by the pager exceeds a predetermined amount.

Also, "Receiver For Local Call" is disclosed in Japanese Laid Open Patent Application (JP-A-Heisei 6-53887). In this reference, a decoder can store desirable message information in a memory without mounting outside the memory, a controller that can be used by a microcomputer or a processor. However, even this technique disclosed in Japanese Laid Open Patent Application (JP-A-Heisei 6-53887) can not prevent the message from being discarded when the message received by the local call receiver exceeds a predetermined amount.

Moreover, "Information Providing Apparatus For Car" is disclosed in Japanese Laid Open Patent Application (JP-A-Heisei 6-152501). In this reference, reception error of information for a driver can be prevented. In this information providing apparatus for a car, when a remaining capacity of a built-in memory of a pager terminal device becomes equal to or less than a predetermined value, a detection signal is detected by a memory capacity detecting unit. A starting unit is activated in accordance with this detection signal. This activation enables a power supply circuit of ECU to be turned on. Then, data stored in the built-in memory is transmitted to a memory of the ECC by a transmitting unit. Accordingly, this apparatus prevents the reception error of the information for the driver resulting from the fact that the built-in memory of the pager terminal device becomes full. However, a technique of classifying and storing received messages into a usual message and a transfer message is not disclosed in Japanese Laid Open Patent Application (JP-A-Heisei 6-152501).

SUMMARY OF THE INVENTION

The present invention is accomplished in view of the above mentioned problems. Therefore, an object of the present invention is to provide a selective call radio receiver having an external connection function, which can prevent a message having an old reception time from being discarded, and a method for transmitting the message.

In order to achieve an aspect of the present invention, a selective call radio receiver with an external connection function, includes a connection section, a normal message storage section, a transfer message storage section and a control section. The connection section is connected with an external unit. The normal message storage section stores normal messages and the transfer message storage section stores transfer messages. The control section classifies a reception message into the normal message and the transfer message based on a header data of the reception message to store in one of the normal message storage section and the transfer message storage section in accordance with the classification. Also, the control section transfers the transfer messages from the transfer message storage section to the external unit through the connection section in response to a transfer instruction.

The selective call radio receiver may further include an output section for outputting an alarm in response to an alarm instruction. The control section checks a usage ratio of the transfer message storage section, and outputs the alarm instruction to the output section, when the usage ratio is equal to or more than a predetermined value. In this case, the output section preferably outputs the alarm in at least one of sound and display. Also, the control section preferably checks the usage ratio of the transfer message storage section for every predetermined time.

The control section may clears the transfer message storage section in response to an clear instruction.

The selective call radio receiver may further include a connection switch for checking whether the external unit is connected and for generating the transfer instruction when it is determined that the external unit is connected.

When the selective call radio receiver has a plurality of identifiers, the control section determines whether the reception message is the normal message or the transfer message, based on a destination identifier contained in the header data of the reception message and the plurality of identifiers.

The control section checks whether the transfer message storage section is full, and stores the transfer message in the normal message storage section, when it is determined that the transfer message storage section is full.

Also, the control section may move the transfer message stored in the normal message storage section into the transfer message storage section in response to a movement instruction.

In addition, the control section may stores the transfer messages in the transfer message storage section in order of reception, and when a portion of the transfer messages stored in the transfer message storage section is cleared, the control section squeezes remaining transfer messages in the transfer message storage section.

In order to achieve another aspect of the present invention, a method of transferring a transfer message to an external unit in a selective call radio receiver, includes:

classifying a reception message into a normal message and a transfer message based on a header data of the reception message to store in one of a normal message storage section and a transfer message storage section in accordance with the classification;

transferring the transfer message from the transfer message storage section to the external unit, which is connected to the selective call radio receiver, in response to a transfer instruction.

BRIEF DESCRIPTION OF THE DRAWINGS

FIG. 7 is a diagram showing configurations of a normal message sector management area, a normal message area, a transfer message sector management area and a transfer message area which are a part of the message storing area shown in FIG. 4;

DESCRIPTION OF THE PREFERRED EMBODIMENTS

A selective call radio receiver having an external connection function of the present invention will be described below in detail with reference to the attached drawings.

In the following description, it is supposed that a personal computer PC is used as an external apparatus. Moreover, it is supposed that this selective call radio receiver has m identifiers $ID_1$, $ID_2$, . . . , $ID_i$, . . . , $ID_m$. Among them, the identifiers $ID_1$ and $ID_2$ are used for an individual call and the identifiers $ID_3$ to $ID_m$ are used to receive information such as a weather forecast, a news and the like.

Figure 1:
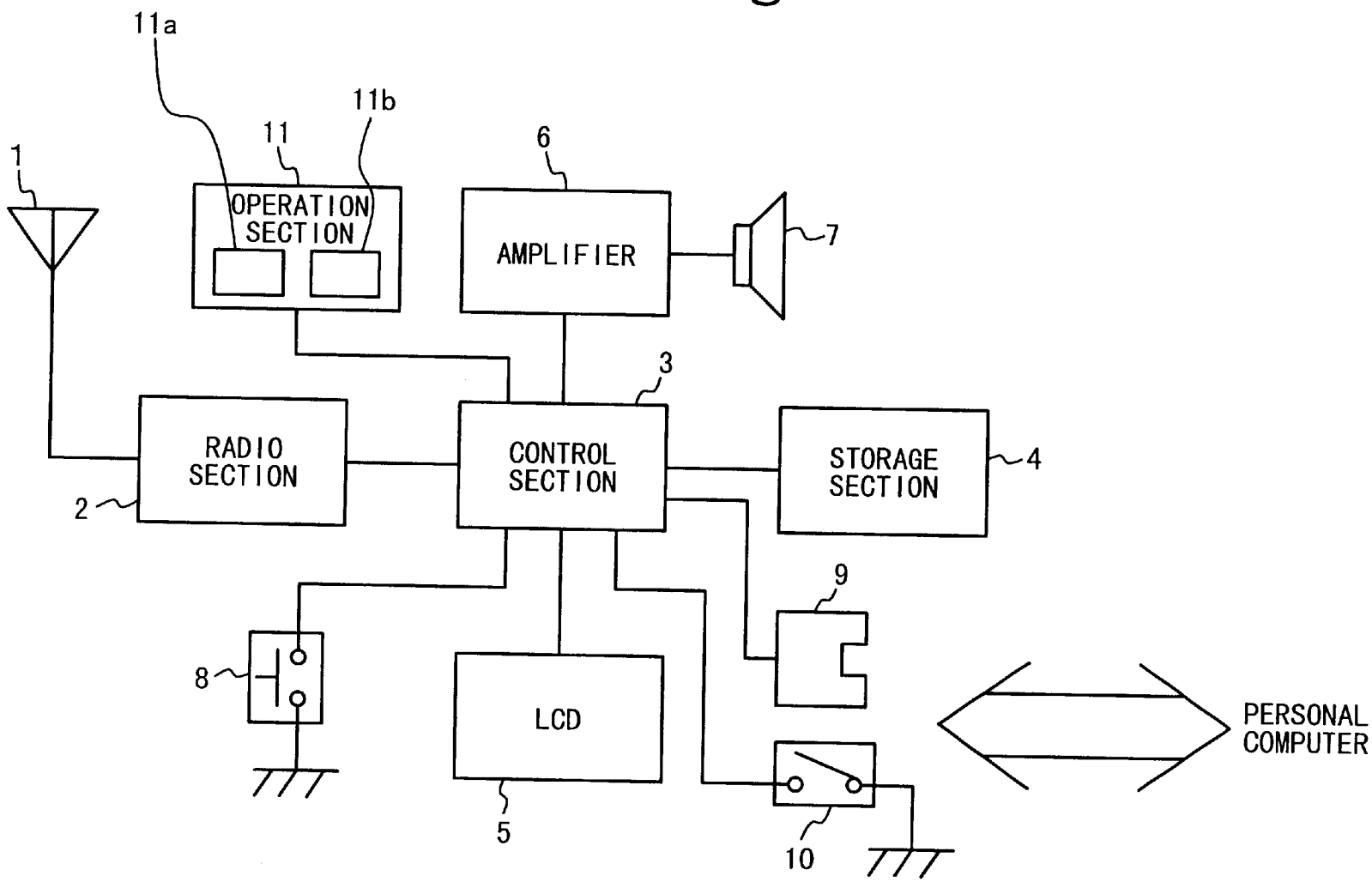
FIG. 1 is a block diagram showing a configuration of a selective call radio receiver having an external connection function according to an embodiment in the present invention.

FIG. 1 is a block diagram showing a configuration of a selective call radio receiver having an external connection function according to an embodiment in the present invention. This selective call radio receiver is composed of an antenna 1, a radio section 2, a control section 3, a storage section 4, an LCD 5, an amplifier 6, a speaker 7, a power supply switch 8, an external terminal 9, a connection switch 10 and an operating section 11.

The antenna 1 receives an electromagnetic wave from a base station (not shown) to convert into an electric radio signal. This radio signal obtained by the antenna 1 is sent to the radio section 2. The radio section 2 amplifies and demodulates the radio signal. This demodulated signal is sent to the control section 3.

The control section 3 controls this selective call radio receiver as a whole. The detailed configuration and operation of the control section 3 will be described later in detail. The storage section 4 is used to temporarily store data used in the control section 3. Moreover, this storage section 4 is used as a message storing area in which a received message is stored. The configuration of the message storing area will be described later in detail.

The LCD 5 displays the received message and other various messages, in accordance with the data sent by the control section 3. The amplifier 6 amplifies a sound signal sent by the control section 3, and then sends it to the speaker 7. The speaker 7 converts the sound signal from the amplifier 6 into a sound. Accordingly, a user can know the reception of a call.

The power supply switch 8 is used to control whether or not an electrical power is supplied to the radio section 2. If this power supply switch 8 is turned on, the electrical power is supplied to the radio section 2. Thus, this selective call radio receiver can receive the message. On the other hand, if the power supply switch 8 is turned off, the supply of the electrical power to the radio section 2 is stopped. Hence, this selective call radio receiver can not receive the message.

The external terminal 9 is used to connect the personal computer PC to this selective call radio receiver by using, for example, a cable. The connection switch 10 is a switch that is turned on if the cable is inserted into the external terminal 9 and turned off if the cable is not inserted. This connection switch 10 is connected to the control section 3. A signal representing the on/off state of the connection switch 10 as a transfer instruction is sent to the control section 3.

The operating section 11 is composed of a manual registration switch 11*a*, a message clear switch 11*b* and other switches. A movement instruction is generated in response to the operation of the manual registration switch 11*a* and a message stored in a later-described usual message area 104 is transferred to a transfer message area 106 in the movement instruction. A clear instruction is generated in response to the operation of the message clear switch 11*b* and any message stored in the transfer message area 106 is cleared in response to the clear instruction. This operating section 11 generates a signal representing an on/off state of each switch, and then sends the signal to the control section 3.

Figure 2:
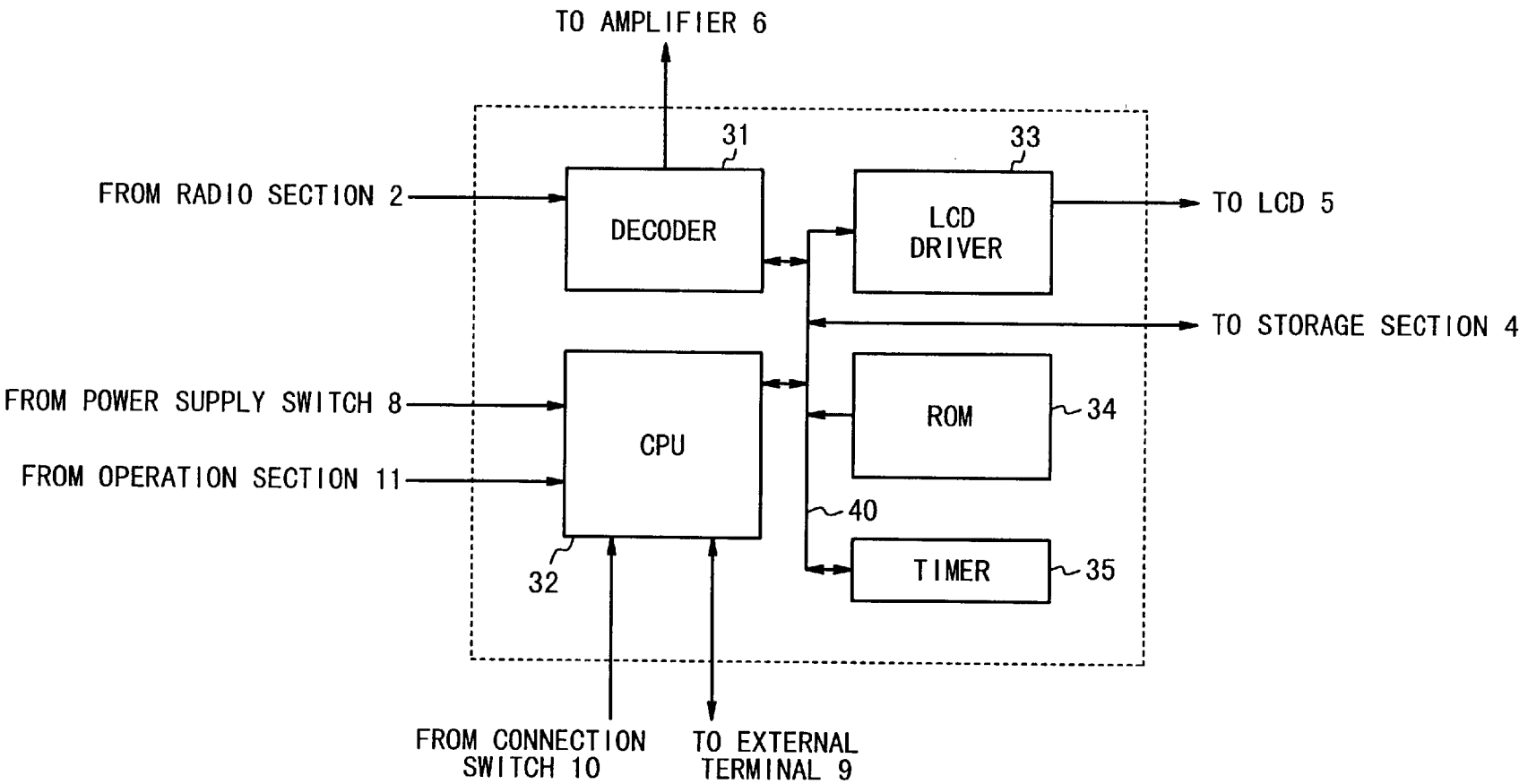
FIG. 2 is a block diagram showing a detailed configuration of a control section shown in FIG. 1.

The detailed configuration of the control section 3 will be described below with reference to a block diagram shown in FIG. 2. The control section 3 is composed of a decoder 31, a CPU 32, an LCD driver 33, an ROM 34, a timer 35 and an internal bus 40 for connecting the respective elements. The internal bus 40 can be constituted of, for example, a 8-bit parallel bus.

Figure 3:
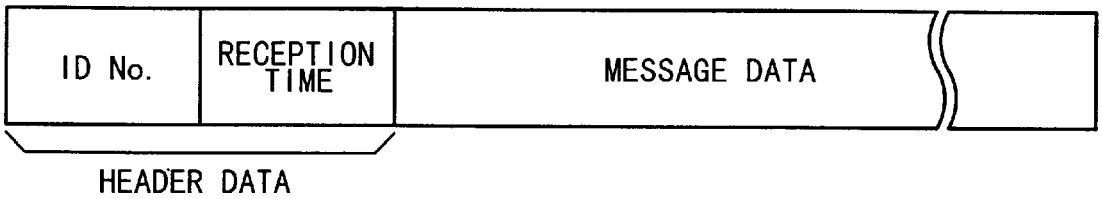
FIG. 3 is a view showing a form of reception data obtained from a decoder shown in FIG. 2.

The decoder 31 decodes the demodulated signal sent from the radio section 2. FIG. 3 shows a form of the reception data obtained through this decoding operation. The reception data is composed of a header data and a message data. The header data includes an ID number and a reception time. The decoder 31 checks whether or not the ID number included in the header data of this reception data is coincident with a self-call number (ID number). Then, if it is determined that the ID number is coincident with the self-call number, the decoder 31 generates a sound signal to send to the amplifier 6. Also, the decoder 31 takes out and holds the message included in the reception data. In addition, the decoder 31 informs to the CPU 32 the fact that the message is received.

For example, a CPU of 8 bits is used as the CPU 32. A program is stored in the ROM 34. The CPU 32 carries out an operation in accordance with the program stored in the ROM 34 to carry out various processes. The processes carried out by the CPU 32 will be described later in detail with reference to flowcharts.

The LCD driver 33 amplifies a signal sent through the internal bus 40 from the CPU 32, and then sends the amplified signal to the LCD 5. Accordingly, a message corresponding to the signal is displayed on the LCD 5.

The timer 35 is, for example, a programmable timer. A predetermined timer value is set in the timer 35 by the CPU 32. The set timer value is decremented at an interval of a predetermined time. As the result of the decrement, if the time value becomes zero, an occurrence of a time-out is recognized. The timer 35 is used to check the amount of messages stored in the transfer message area 106 of the storage section 4, for each predetermined time.

Figure 4:
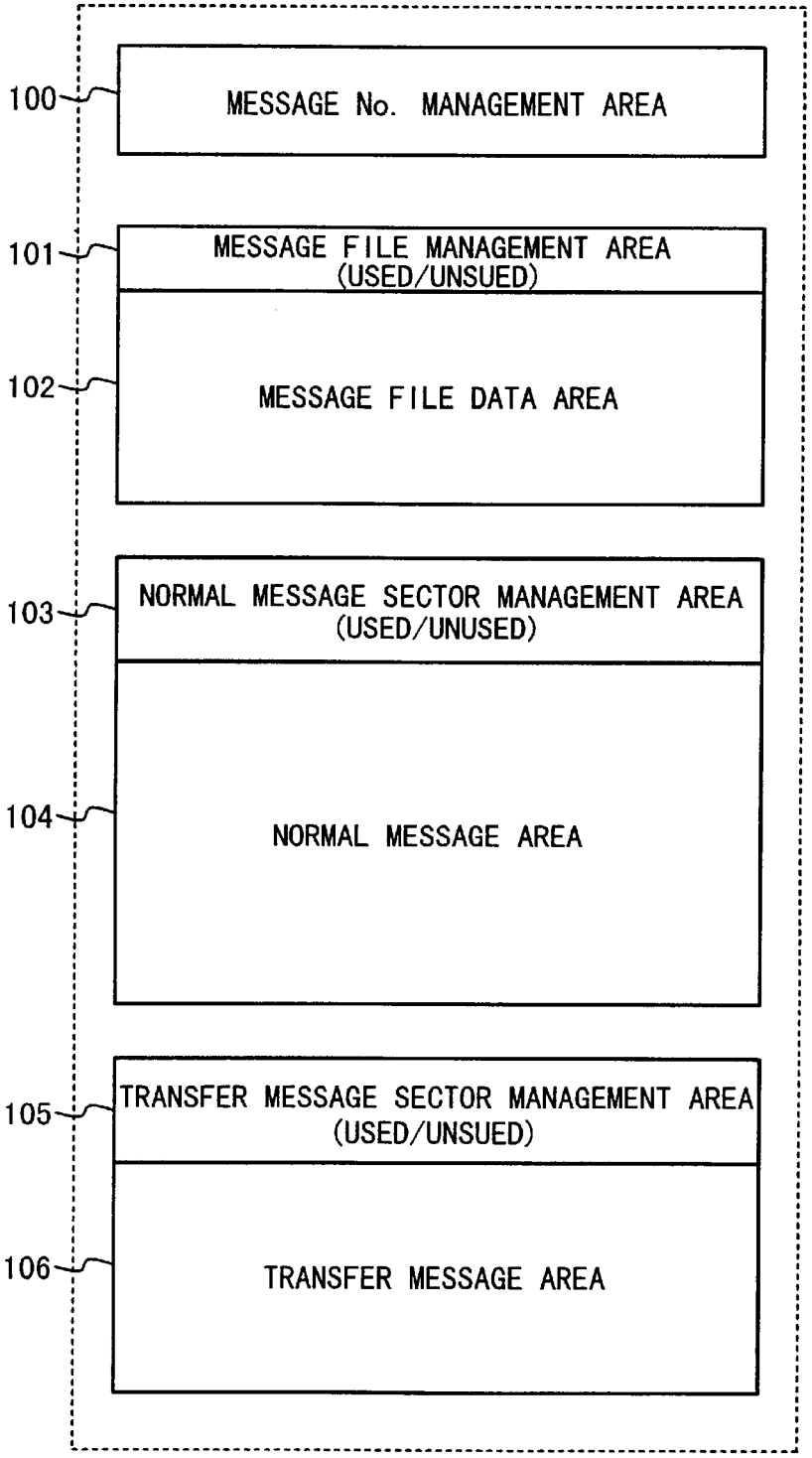
FIG. 4 is a view showing a configuration of a message storing area prepared in a memory shown in FIG. 1.

The configuration of the message storing area formed in the storage section 4 will be described below with reference to FIGS. 4 to 7. As shown in FIG. 4, the message storing area is composed of a message number management area 100, a message file management area 101, a message file data area 102, a normal message sector management area 103, a normal message area 104, a transfer message sector management area 105 and a transfer message area 106.

Figure 5:
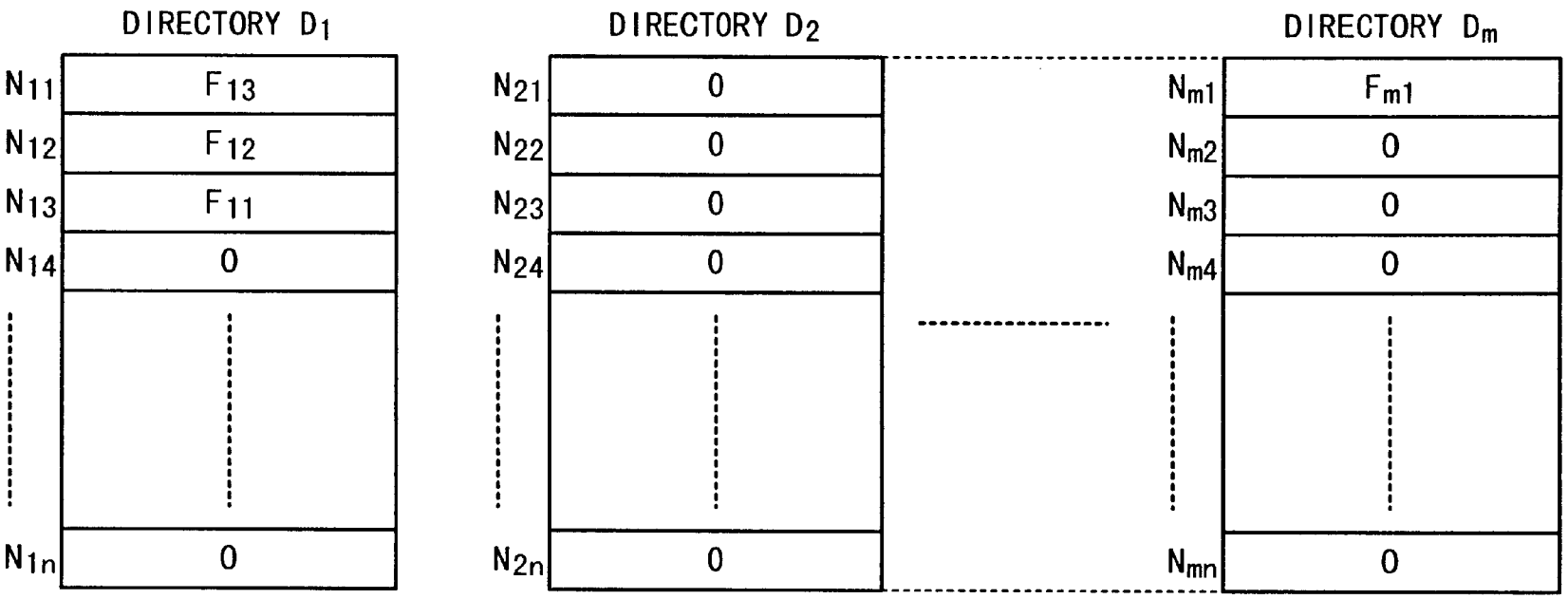
FIG. 5 is a view showing a configuration of a message number management area which is a part of the message storing area shown in FIG. 4.

As shown in FIG. 5, the message number management area 100 is composed of m directories $D_1, D_2, \ldots, D_i, \ldots$, and $D_m$ which respectively correspond to m identifiers $ID_i$, $ID_2 \ldots ID_i, \ldots$, and $ID_m$. Each directory $D_i$ (i=1, 2, . . . , and m) is composed of n entries $N_{i1}, N_{i2}, \ldots, N_{iu}, \ldots$, and $N_{in}$. Message file numbers $F_{iv}$ (v=1, 2, . . . , and n) which will be described later are stored in respective $N_{iu}$ (u=1, 2, . . . , and n).

FIG. 5 shows the situation that the message file number $F_{l3}$ is stored in the entry $N_{l1}$, the message file number $F_{l2}$ is stored in the entry $N_{l2}$, the message file number $F_{l1}$ is stored in the entry $N_{l3}$ and the message file number $F_{ml}$ is stored in the entry $N_{ml}$, respectively. It should be noted that a content of each entry $N_{iu}$ is set to 0 at an initial state. A FIFO memory is provided to stack the messages in the order of reception, although the FIFO is not shown in FIG. 5. The FIFO memory is used to determine the message having the oldest reception time (the details will be described later).

Figure 6:
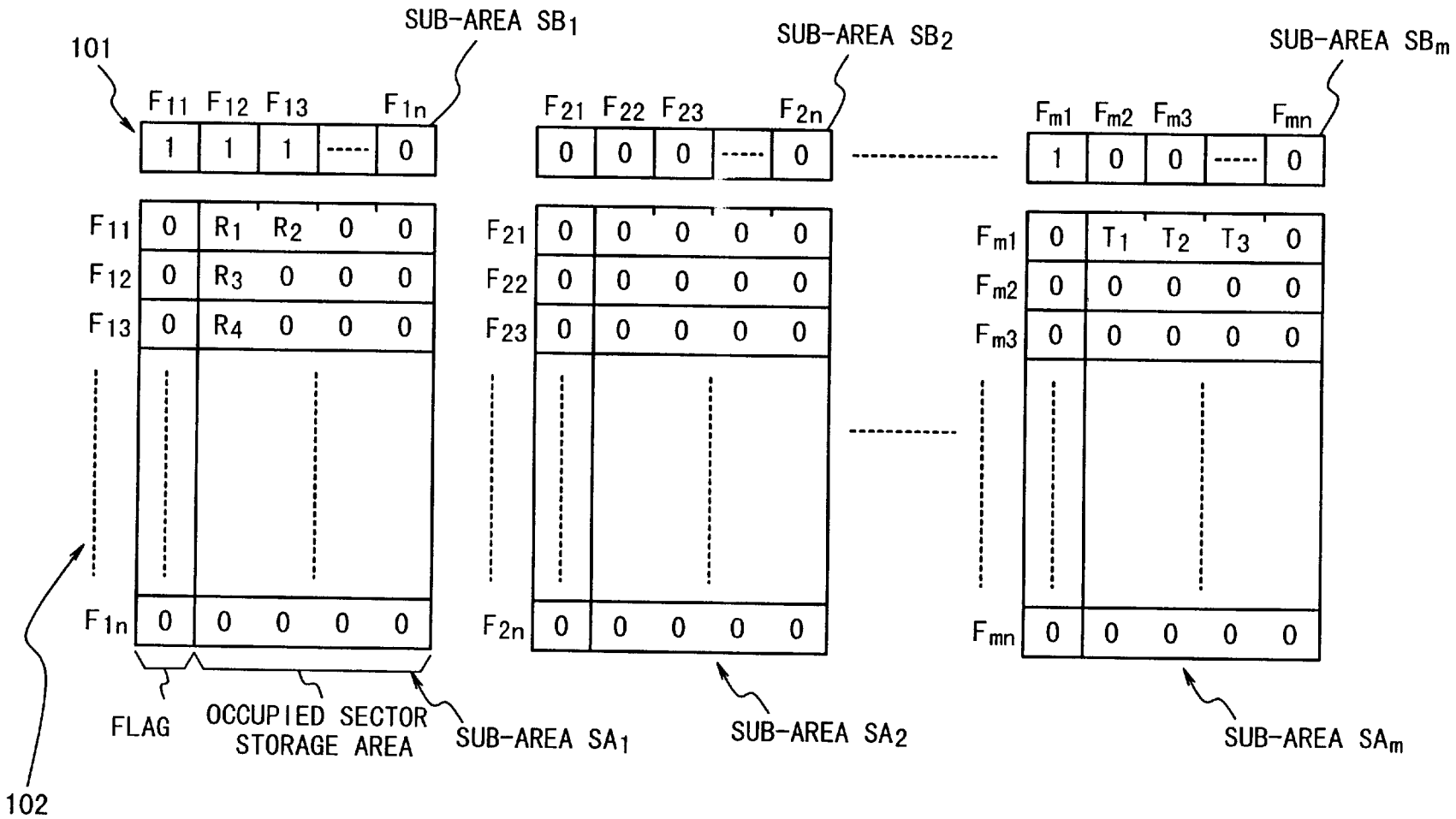
FIG. 6 is a diagram showing configurations of a message file data area and a message file management area which are a part of the message storing area shown in FIG. 4.

As shown in FIG. 6, the message file data area 102 is composed of m sub-areas $SA_1, SA_2, \ldots, SA_i, \ldots$, and $SA_m$ which respectively correspond to the above-mentioned m directories $D_1, D_2, \ldots D_i, \ldots$, and $D_m$. Each sub-area $SA_i$ is composed of n entries having the same titles as the message file number $F_{il}, Fi_{i2}, \ldots F_{iv}, \ldots$, and $F_{in}$.

Each entry $F_{iv}$ is composed of a flag and an occupied sector storage area. The flag is used to discriminate the normal message from the transfer message. "0" is stored in the flag in a case of the normal message, and "1" is stored in the flag in a case of the transfer message. A later-described sector number is stored in the occupied sector storage area.

FIG. 6 shows the following situation. That is, a message file to which the message file number $F_{l1}$, is given is stored in sectors specified by sector numbers $R_1$ and $R_2$ as the normal message. A message file to which the message file number $F_{l2}$ is given is stored in a sector specified by a sector number $R_3$ as the normal message. A message file to which the message file number $F_{l3}$ is given is stored in a sector specified by a sector number $R_4$ as the normal message. In addition, a message file to which the message file number $F_{ml}$ is given is stored in sectors specified by sector numbers $T_1$, $T_2$ and $T_3$ as the transfer message.

As shown in FIG. 6, the message file management area 101 is composed of m sub-areas $SB_1, SB_2, \ldots, SB_i, \ldots$, and $SB_m$ which respectively correspond to the above-mentioned m directories $D_1, D_2, \ldots, D_i, \ldots$, and $D_m$ Each sub-area $SB_i$ has n memory areas which respectively correspond to the message file numbers $F_{il}, F_{i2}, \ldots, F_{iv}, \ldots$, and $F_{in}$, and stores therein a usage state of each entry of the corresponding sub-area $SA_i$. In this case, "1" is set if the entry $F_{iv}$ is being used, and "0" is set if it is not used. If a message file is newly stored, an empty entry of the sub-area $SA_i$ is retrieved by referring to the sub-area $SB_i$ of this message file management area 101.

As shown in FIG. 7, the normal message area 104 is composed of j sectors which respectively correspond to sector numbers $R_1, R_2, \ldots$, and The normal message is stored in each sector. Similarly, as shown in FIG. 7, the transfer message area 106 is composed of k sectors which respectively correspond to sector numbers $T_1, T_2, \ldots$, and $T_j$. The transfer message is stored in each sector.

As shown in FIG. 7, the normal message sector management area 103 is composed of j memory areas which respectively correspond to the sector numbers $R_1$, $R_2$, and $R_j$, and stores therein the usage state of each sector of the above-mentioned normal message area 104. In this case, "1" is stored if the corresponding sector is being used, and "0" is stored if it is not used. Similarly, the transfer message sector management area 105 is composed of k memory areas which respectively correspond to the sector numbers $T_1$, $T_2$, and $T_j$, and stores therein the usage state of each sector of the above-mentioned transfer message area 106. Also in this case, "1" is stored if the corresponding sector is being used, and "0" is stored if it is not used.

In the example shown in FIG. 7, the message file to which the message file number $F_{l1}$ is given is composed of two sectors specified by the sector numbers $R_1$ and $R_2$ of the normal message area 104. The content of the message indicates that "Open electronics parts exhibition at the 3rd meeting room from 3:00, today".

The operations of the selective call radio receiver having the above-mentioned configuration will be described below with reference to flowcharts shown in FIGS. 8 to 16. It should be noted that the processes shown in the respective flowcharts are carried out by the CPU 32.

(1) Main Process

Figure 8:
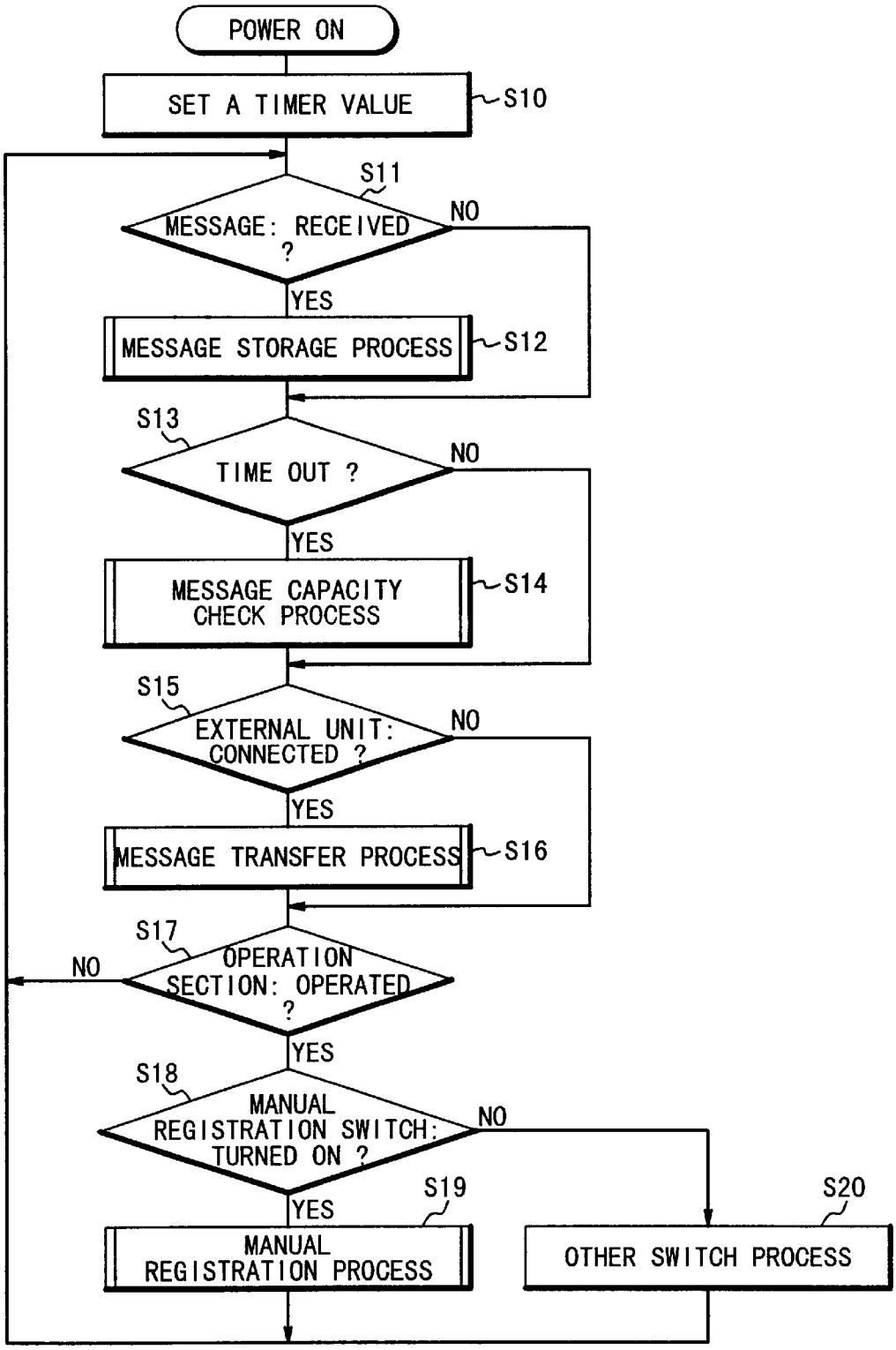
FIG. 8 is a flowchart showing a main process of the selective call radio receiver having the external connection function according to the embodiment in the present invention.

At first, a main process will be described with reference to the flowchart shown in FIG. 8. The main process routine is started when the power supply is turned on in response to the operation of the power supply switch 8.

When the power supply is turned on, a receiving operation is started. Then, a timer value is firstly set in the timer 35 (Step S10). That is, the CPU 32 sets a predetermined timer value in the timer 35 through the internal bus 40. Accordingly, the timer 35 starts the decrement at an interval of a predetermined time.

Next, it is checked whether or not a message is received (Step S11). That is, the CPU 32 checks whether or not a signal representing the reception of the message is sent from the decoder 31. If it is determined that the message is received, a message storing process is executed (Step S12). In this message storing process, the received message is taken out from the decoder 31, and then a process of storing in the message storing area of the storage section 4 is executed. This message storing process will be described later in detail. On the other hand, if it is determined at the step S11 that the message is not received, a process at a step S12 is skipped.

Next, the timer 35 is checked as to whether or not it has expired (Step S13). That is, the CPU 32 reads out a present timer value from the timer 35, and checks whether or not the timer value is zero. If it is determined that the timer 35 has expired, it is recognized that a certain time has elapsed from a previous message capacity checking process or since the power supply has been turned on. Then, the message capacity checking process is executed (Step S14). In the message capacity checking process, if a usage ratio of the transfer message area 106 exceeds a predetermined value, a process of informing that fact to a user is executed. The message capacity checking process will be described later in detail. On the other hand, if it is determined at the step S13 that the timer 35 has not expired, the process at the step S14 is skipped.

Next, it is checked whether or not an external unit is connected, namely, the personal computer PC is connected (Step S15). That is, the CPU 32 reads the signal representing the on/off state from the connection switch 10, and checks whether or not the connection switch 10 is turned on. Then, if it is determined that the external unit is connected, namely, the connection switch 10 is turned on, a message transferring process is executed (Step S16). In the message transferring process, the message stored in the transfer message area 106 is transferred through the external terminal 9 to the personal computer PC. The message transferring process will be described later in detail. On the other hand, if it is determined at the step S15 that the external unit is not connected, this process at the step S16 is skipped.

Next, it is checked whether or not any one of the switches contained in the operating section 11 is operated (Step S17). That is, the CPU 32 reads out a signal representing an on/off state of each switch from the operating section 11, and checks whether or not any one of the switches is turned on, in accordance with this read out signal. If it is determined that any one of the switches contained in the operating section 11 is operated, it is next checked whether or not the manual registration switch 11*a* is turned on (Step S18).

If it is determined that the manual registration switch 11*a* is not turned on, the control returns back to the step S11. On the other hand, if it is determined that the manual registration switch 11*a* is turned on, a manual registration process is executed (Step S19). In the manual registration process, the message stored in the normal message area 104 is manually transferred to the transfer message area 106. The manual registration process will be described later in detail.

After that, the control returns back to the Step S11. If it is determined at the step S19 that the manual registration switch 11*a* is not turned on, the processes corresponding to the operations of the other switches are carried out (Step S20). After that, the control returns back to the step S11.

Hereafter, the similarly repeated execution of the processes at the steps S11 to S20 can achieve the function of transferring the transfer message to the personal computer PC and various functions as the selective call radio receiver.

(2) Message Storing Process

Figure 9A:
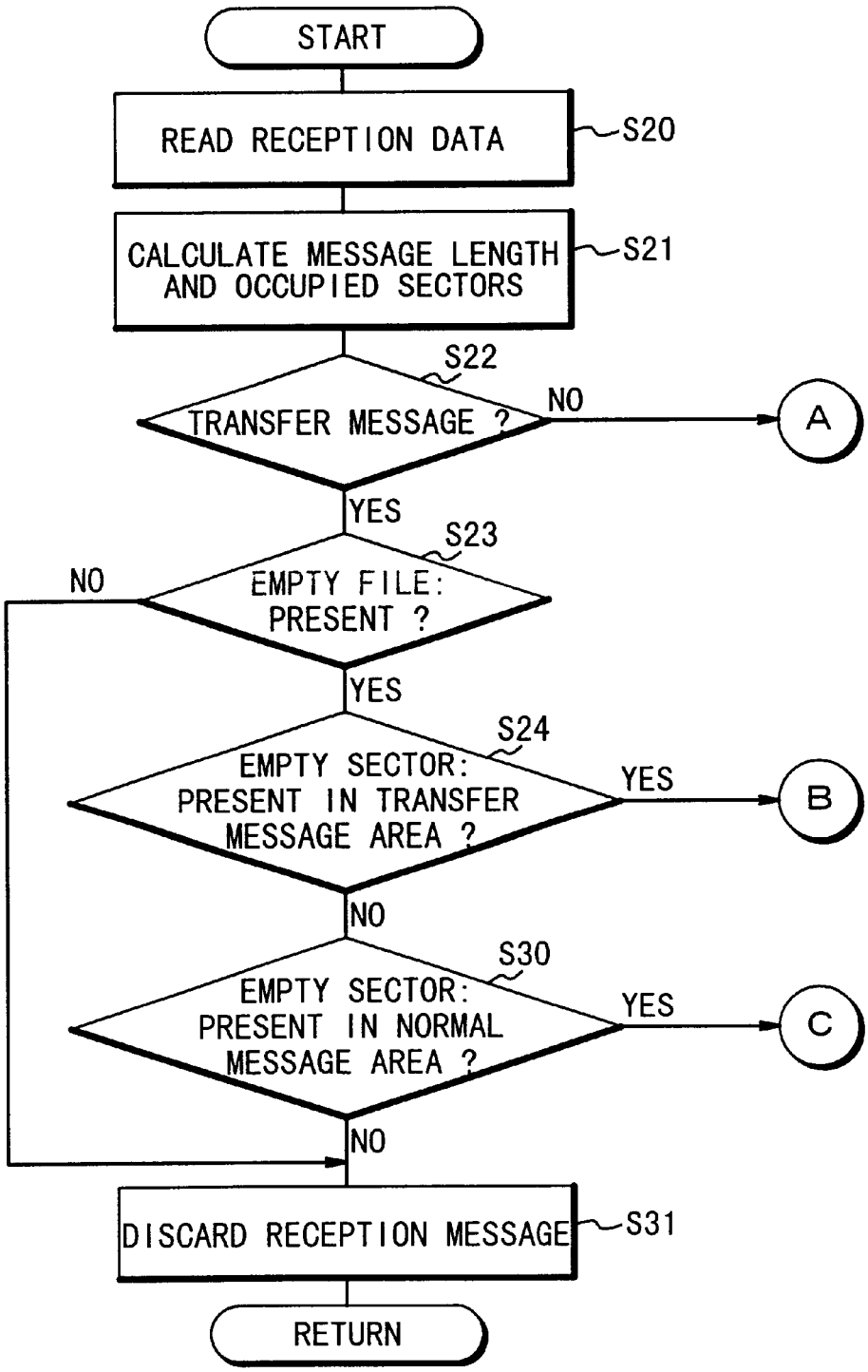
FIGS. 9A to 9C are flowcharts showing a message storing process of the selective call radio receiver having the external connection function according to the embodiment in the present invention.
Figure 9B:
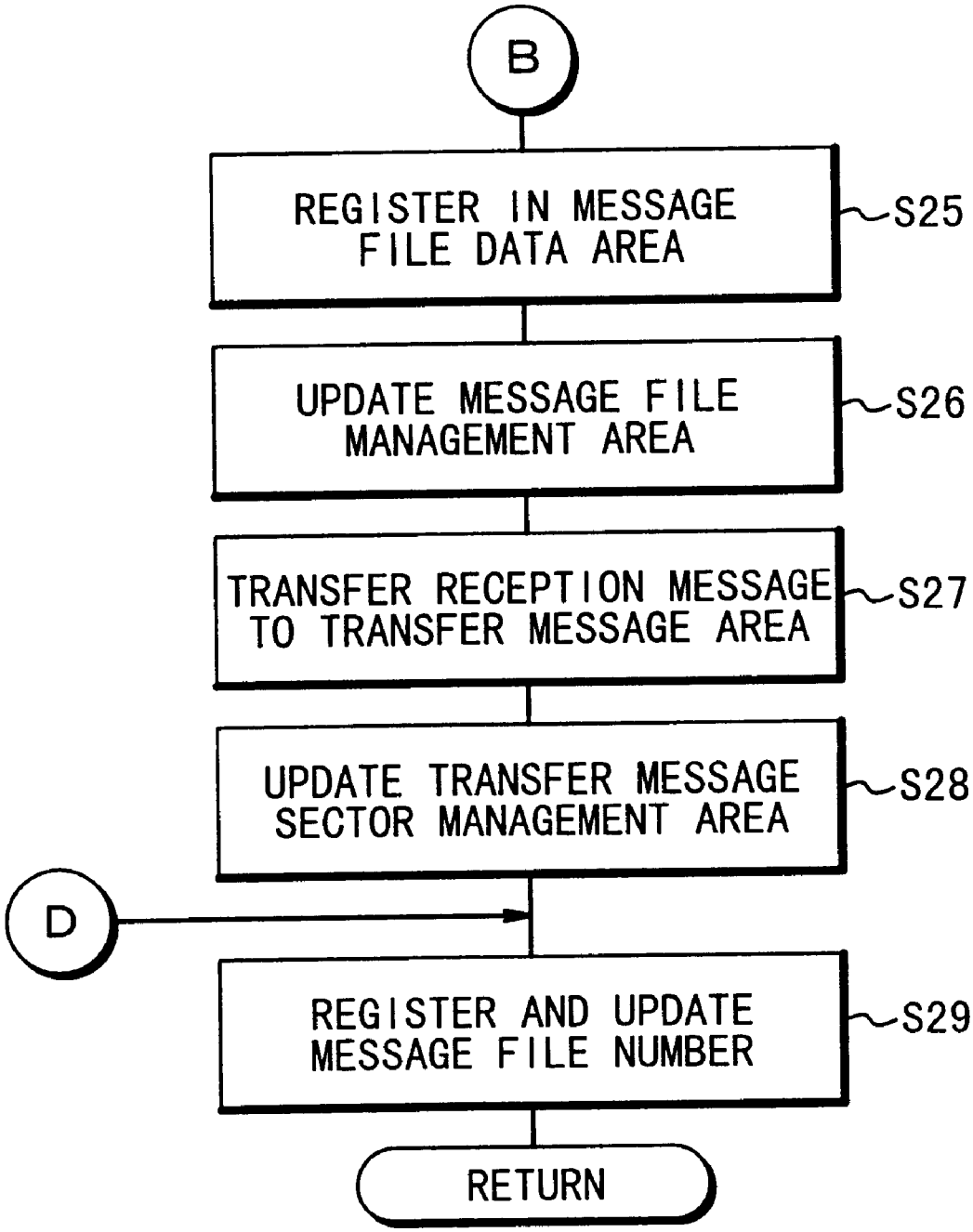
Figure 9C:
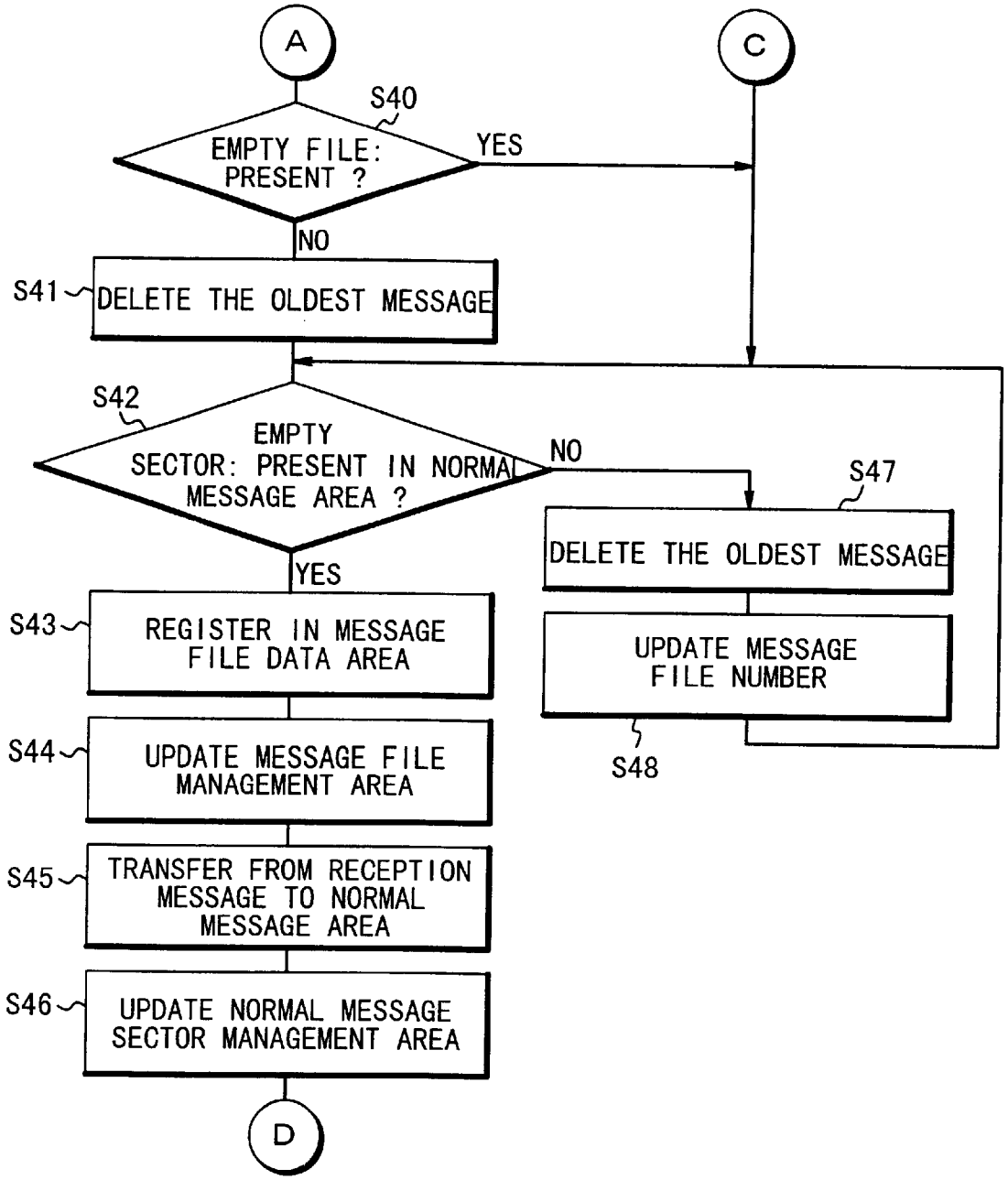
Figure 10:
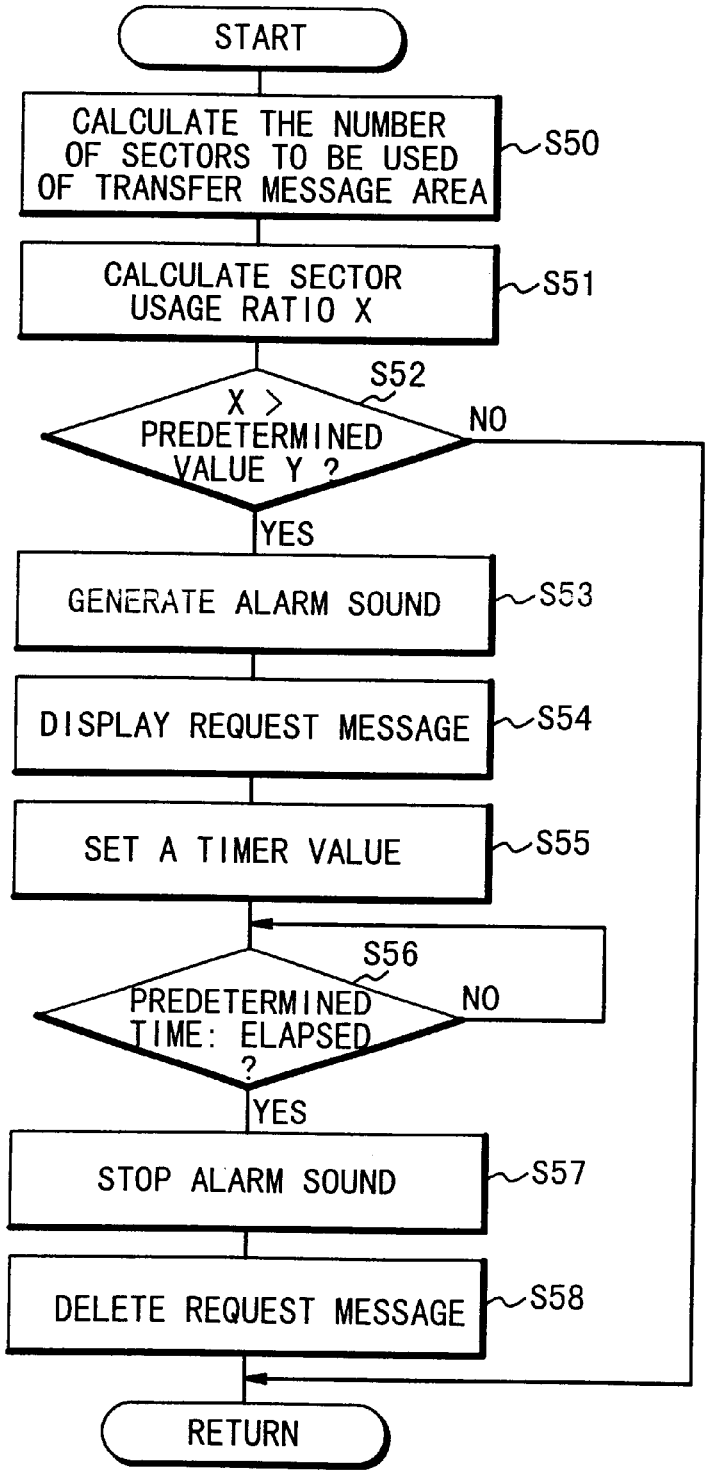
FIG. 10 is a flowchart showing a message capacity checking process of the selective call radio receiver having the external connection function according to the embodiment in the present invention.
Figure 11A:
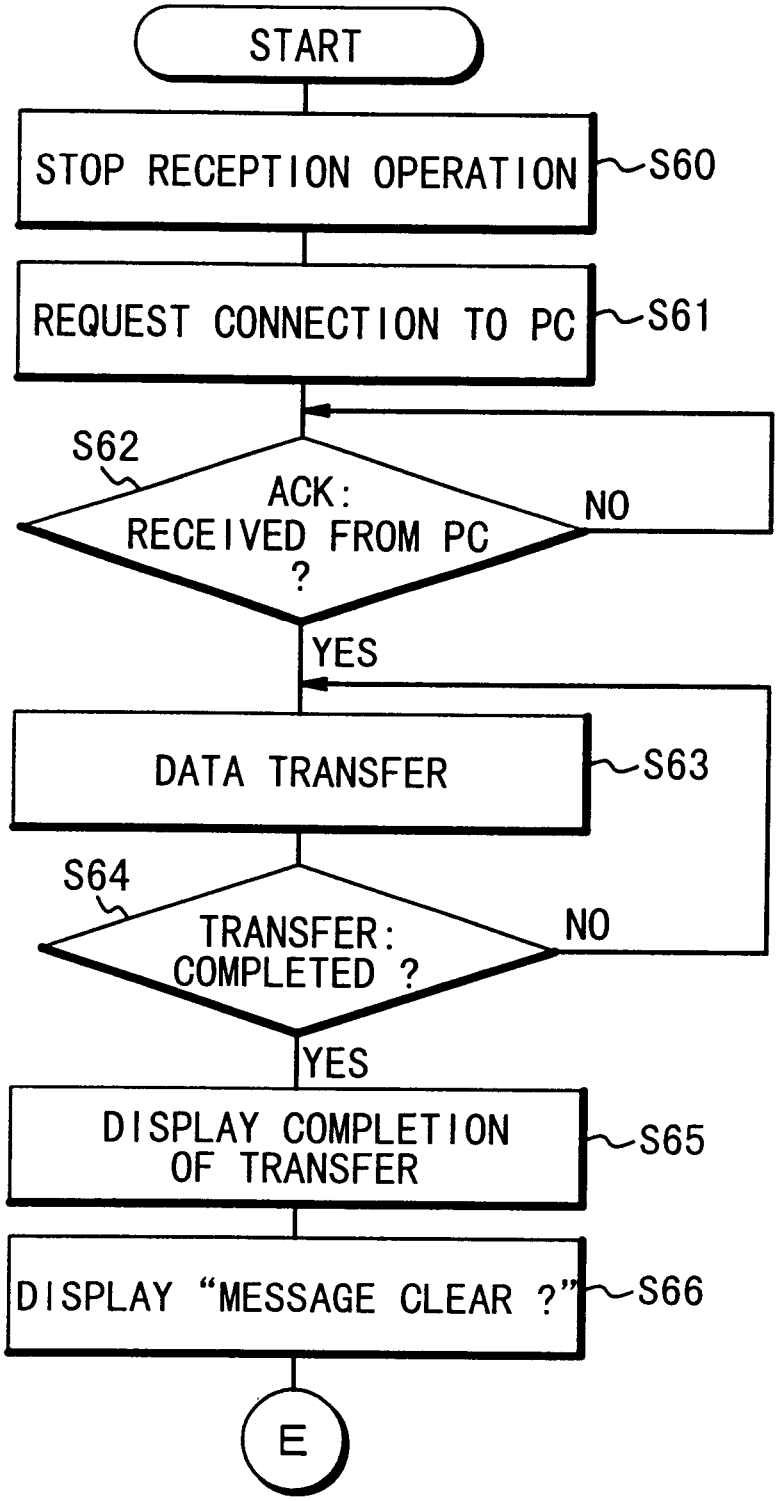
FIGS. 11A and 11B are flowcharts showing a message transferring process of the selective call radio receiver having the external connection function according to the embodiment in the present invention.
Figure 11B:
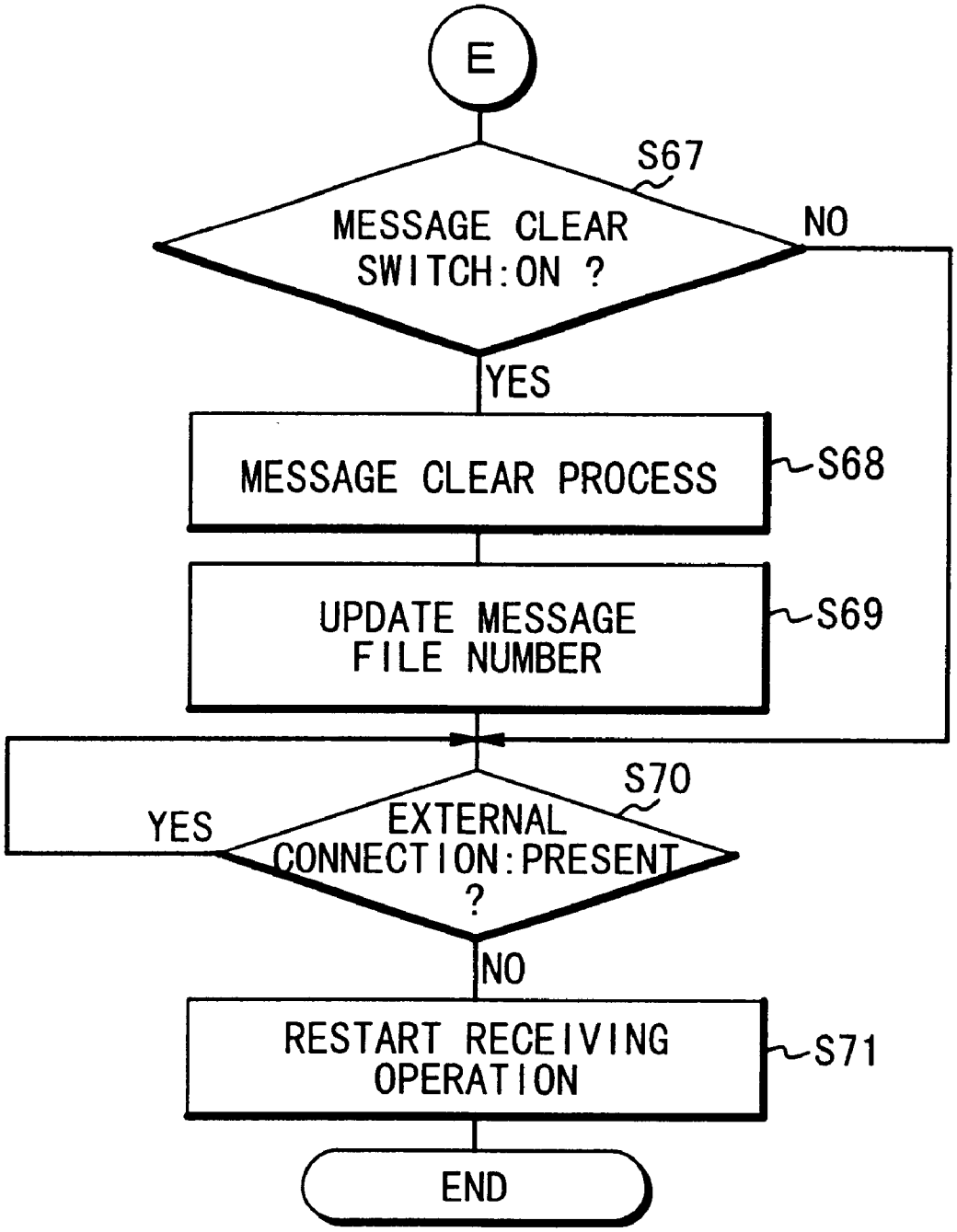

The message storing process will be described below with reference to the flowcharts shown in FIGS. 9 to 11. The message storing process routine is called from the step S12 of the main process routine.

In the message storing process, the reception data stored in the decoder 31 is firstly read out therefrom (Step S20). The read out reception data is transferred to a buffer area (not shown) provided within the storage section 4. Next, a length of a message and occupied sectors are calculated (Step S21). This calculation is performed in accordance with the reception data stored in the buffer area.

Next, it is checked whether or not the received message is a transfer message (Step S22). This is performed in accordance with the header data of the reception data stored in the buffer area. That is, it is checked whether or not an ID number in the header data is one of the identifiers $ID_3$ to $ID_m$. If the received message is determined to be not the transfer message, the control branches into a step S40. Then, the process of storing the normal message is executed at steps S40 to S48.

On the other hand, if the received message is determined to be the transfer message, the process of storing the transfer message is executed at the steps S23 to S31. That is, it is firstly checked whether or not any empty file is present (Step S23). This is performed by checking whether or not a memory area set to "0" is present in the message file management area 101. If it is determined that the empty area is not present, the received message is discarded (Step S31). After that, the control returns from this routine of the message storing process to the step S13 of the main process routine.

If it is determined at the step S23 that an empty file is present, a message file number corresponding to the empty file is acquired. Then, it is checked whether or not an empty sector is present in the transfer message area 106 (Step S24). This is performed by checking whether or not the memory area set to "0" is present in the transfer message sector management area 105, by an amount corresponding to the occupied sectors calculated at the step S21.

If it is determined that the empty sectors are present, a sector numbers of the sector are acquired. Then, a process of registering on the message file data area 102 the sector number assigned to the received message is executed (Step S25). In this process, "1" is set in a flag of an entry corresponding to the message file number acquired at the above-mentioned step, in the message file data area 102, and further the acquired sector number is stored in the occupied sector storage area.

Next, the message file management area 101 is updated (Step S26). That is, "1" is set in a memory area corresponding to the acquired message file number, in the message file management area 101.

Next, the received message is transferred to the transfer message area 106 (Step S27). That is, message data of the reception data stored in the buffer area of the storage section 4 is read out, and stored in the sectors specified by the acquired sector numbers. Next, the transfer message sector management area 105 is updated (Step S28). That is, "1" is set in memory areas corresponding to the acquired sector numbers, in the transfer message sector management area 105.

Next, the message file number is registered and updated (Step S29). That is, the acquired message file number is registered on the message number management area 100, and then the message file number is rearranged. This rearrangement is performed in such a way that a finally registered message file number is located at a top of the directory. After that, the control returns from this message storing process routine to the step S13 of the main process routine.

If it is determined at the step S24 that nay empty sector is not present in the transfer message area 106, it is next checked whether or not any empty sector is present in the normal message area 104 (Step S30). If it is determined that any empty sector is not present, the received message is discarded (Step S31). After that, the control returns from the message storing process routine to the step S13 of the main process routine. Through the execution of the above-mentioned processes, the received transfer messages can be stored in the transfer message area 106 of the message storing area in order.

On the other hand, if it is determined that an empty sector is present, the controls branches into the step S42. Then, a normal message storing process is executed in which the transfer message is stored in the normal message area 104, as described later. Accordingly, the following function is achieved. That is, when the transfer message area 106 is full, the transfer message is not discarded. If the empty sector is present in the normal message area 104, the transfer message is stored in the empty sector.

The normal message storing process will be described below. In this normal message storing process, it is firstly checked whether or not an empty file is present (Step S40). This is performed by using the method similar to that of the step S23. If it is determined that the empty file is not present, a process of erasing the oldest message is executed (Step S41). In this process, one message file number is taken out from the FIFO (not shown) in the message number management area 100. The taken out message file number is the oldest message file number. Then, a content of a directory of the message number management area 100 in relation to this message file number, a content of the message file management area 101, a content of the message file data area 102, a content of the normal message sector management area 103 and a content of the normal message area 104 are erased or cleared to zero.

Next, it is checked whether or not the empty sector is present in the normal message area 104 (Step S42). This is performed by using the method similar to the step S24. If it is determined that the empty sector is present, the sector number of the sector is acquired. Next, the process of registering on the message file data area 102 the sector number assigned to the received message is executed (Step S43). The process is similar to the process carried out at the step S25.

Next, the message file management area 101 is updated (Step S44). This process is similar to that at the step S26. Next, the received message is transferred to the normal message area 104 (Step S45). That is, the message data in the reception data stored in the buffer area of the storage section 4 is read out and then stored in a sector specified by the obtained sector number. Next, the normal message sector management area 103 is updated (Step S46). That is, "1" is set in a memory area corresponding to the acquired sector number, in the normal message sector management area 103. After that, the control branches into the step S29. Then, the message file number is registered and updated, as mentioned above.

If it is determined at the step S42 that the empty sector is not present, the process of erasing the oldest message is executed (Step S47). This process is similar to the process carried out at the step S41. Next, the message file number is updated (Step S48). More particularly, if an empty portion is generated between the message file numbers of the message number management area 100 through the process at the step S47, a process rearranging the message file numbers to fill the empty portion is carried out. After that, the control returns back to the step S42. The similar processes are repeated until the empty sectors corresponding to a portion in which the received message can be stored are reserved or provided.

Through the execution of the above-mentioned processes, the received normal messages can be stored in order in the normal message area 104 of the message storing area. In this case, the following function is achieved. That is, if a newly received message can not be stored since the normal message area 104 or the message file data area 102 is full, the newly received message is stored after the erasure of the oldest message.

(3) Message Capacity Checking Process

Figure 12A:
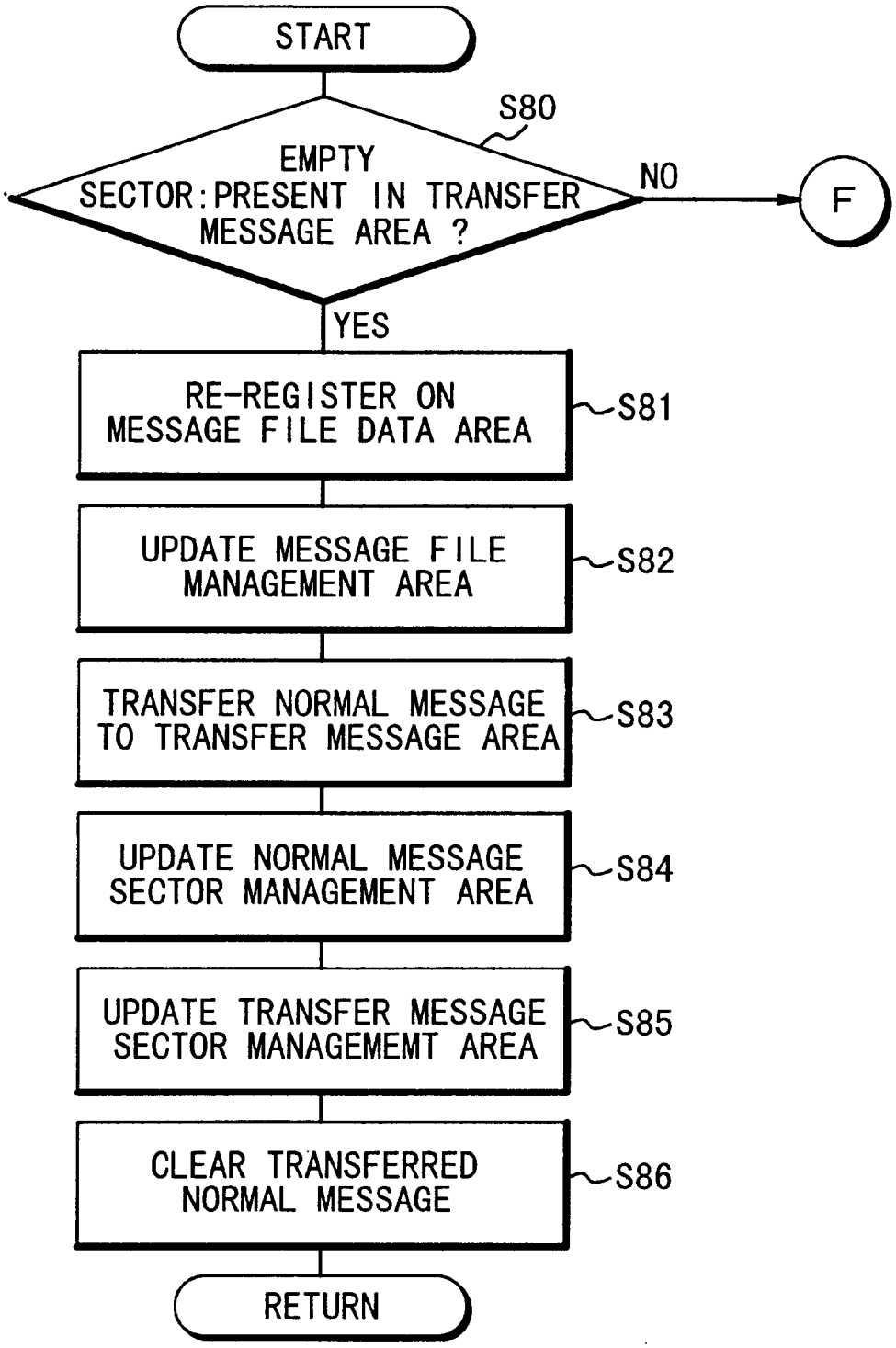
FIGS. 12A and 12B are flowcharts showing a (first) manual registration process of the selective call radio receiver having the external connection function according to the embodiment in the present invention.
Figure 12B:
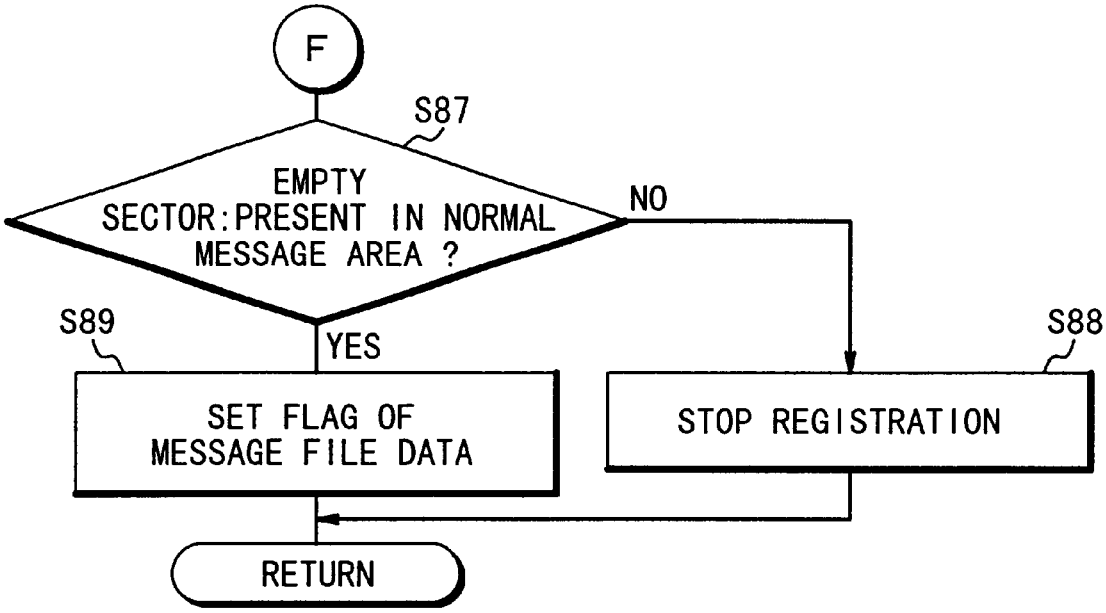

A message capacity checking process will be described below with reference to the flowchart shown in FIG. 12. The message capacity checking process is called from the step S14 of the main process routine.

In the message capacity checking process, the number of sectors being used in the transfer message area 106 is firstly calculated (Step S50). This is performed by calculating the number of memory areas set to "1" in the transfer message sector management area 105. Next, a current sector usage ratio X is calculated (Step S51). This is calculated by dividing the number of sectors calculated at the step S50 by the number k of all sectors in the transfer message area 106.

Next, it is checked whether or not the sector usage ratio X calculated at the step S51 exceeds a predetermined value Y (Step S52). If it is determined that the sector usage ratio X is equal to or less than the predetermined value Y, the control returns from the message capacity checking process routine to the step S15 of the main process routine. Thus, if the sector usage ratio X is equal to or less than the predetermined value Y, an emission of an alarm tone or a display of a prompt message as described later are not carried out.

On the other hand, if it is determined at the step S52 that the sector usage ratio X exceeds the predetermined value Y, the alarm tone is emitted (Step S53). That is, the CPU 32 sends a signal through the decoder 31 and the amplifier 6 to the speaker 7 to emit the alarm tone. Accordingly, the alarm tone is emitted by the speaker 7.

Next, the prompt message is displayed to prompt the transfer of the message stored in the transfer message area 106 to the personal computer PC (Step S54). That is, the CPU 32 sends a signal through the LCD driver 33 to the LCD 5 to display the prompt message. Accordingly, the prompt message is displayed on the LCD 5. Next, a predetermined timer value is set in the timer 35 (Step S55). The set timer value is equal to the timer value set at the step S10.

Next, it is checked whether or not a predetermined time elapses (Step S56). If it is determined that the predetermined time elapses, the alarm tone is extinguished (Step S57). That is, the CPU 32 sends a signal through the decoder 31 and the amplifier 6 to the speaker 7 to extinguish the alarm tone. Accordingly, the emitting of the alarm tone from the speaker 7 is stopped. Next, the prompt message is extinguished (Step S58). That is, the CPU 32 sends a predetermined signal through the LCD driver 33 to the LCD 5. Accordingly, the prompt message displayed on the LCD 5 is extinguished. After that, the control returns from the message capacity checking process routine to the step S15 of the main process routine. Therefore, the function can be achieved to extinguish the alarm tone and the prompt message when the predetermined time elapses after the emission of the alarm tone and the display of the prompt message.

As mentioned above, if the current sector usage ratio exceeds the predetermined sector usage ratio, the alarm tone is emitted by the speaker 7, and the message of prompting the transfer is displayed on the LCD 5. Thus, before the old message is discarded, the user can connect the personal computer PC to this selective call radio receiver and then transfer the transfer message stored in the transfer message area 106 to the personal computer PC. Therefore, it is possible to prevent the message from being discarded before the user reads the message.

(4) Message Transferring Process

The message transferring process will be described below with reference to the flowcharts shown in FIGS. 13 and 14. The message transferring process routine is called from the step S16 of the main process routine.

In this message transferring process, the receiving operation is firstly stopped (Step S60). This is performed by, for example, stopping the operation of the decoder 31. Next, a connection request is sent to the personal computer PC (not shown) (Step S61). This is performed by issuing an STX command, in order to establish a communication path to the personal computer PC. After that, while repeatedly executing the operation at a step 62, the control waits for the reception of an ACK signal (acceptance signal) from the personal computer PC.

The establishment of the communication path is recognized if it is determined that the ACK signal is received from the personal computer PC, in the above-mentioned condition. Then, data is transferred (Step S63). That is, one message is taken out from the transfer message area 106, and transferred to the personal computer PC. Next, it is checked whether or not the transfers of all the messages from the transfer message area 106 are completed (Step S64). If it is determined that the transfers are not completed, the control returns back to the step S63, and the similar processes are repeated hereafter.

If it is determined at the step S64 in these repeatedly executed processes that the transfers are completed, a message of "Transfer Completion" is displayed on the LCD 5 (Step S65). This is performed by sending display data indicative of a character string of "Transfer Completion" from the CPU 32 to the LCD 5 through the LCD driver 33. Next, a message of "Message Clear?" is displayed on the LCD 5 (Step S66). This is performed by sending the display data indicative of the character string of "Message Clear ?" from the CPU 32 to the LCD 5 through the LCD driver 33.

Next, it is checked whether or not the message clear switch 11*b* of the operating section 11 is turned on (Step S67). If it is determined that the message clear switch 11*b* is turned on, the message clearing process is carried out (Step S68). In this process, a content of each sector in the transfer message area 106, a content of the transfer message sector management area 105, message file numbers of the message file data area 102 corresponding to the transferred messages, memory areas of the message file management area 101 corresponding to the transferred messages, and message file numbers of the message storing area 100 corresponding to the transferred messages are cleared to zero.

Next, the message file numbers are updated (Step S69). Namely, a process is executed to move the message file numbers to fill an empty portion brought about in a directory as the result of that the message file numbers of the message number storing area 100 are cleared at the step S68. If it is determined at the step S67 that the message clear switch 11*b* is not turned on, the processes at the steps S68 and S69 are skipped.

Next, it is checked whether or not an external unit is connected (Step S70). If it is determined that the external unit is connected, the control waits until the external unit is disconnected while repeatedly executing this process at the step S70. That is, the control waits until the connection switch 10 is released by removing a cable connected to the external terminal 9. Then, if the external unit is disconnected, a process of restarting the receiving operation is executed (Step S71). This is performed by, for example, restarting the operation of the decoder 31 stopped at the step S60. After that, the control returns from the message clearing process routine to the step S17 of the main process routine.

Though the execution of the above-mentioned processes, the cable is connected to the external terminal 9, so that all the messages stored in the transfer message area 106 are automatically sent to the personal computer PC. Therefore, it is not necessary to select the messages to be transferred from the side of the personal computer PC. Moreover, when the transfers of the messages are completed, the user can determine whether or not the content of the transfer message area 106 should be discarded. Therefore, the user can cope with a case of a failure of the transfer and the like.

(5) Manually Registering Process

Next, a manual registration process will be described below with reference to the flowcharts shown in FIGS. 15 and 16. This manual registration process is carried out in order to register the normal messages stored in the normal message area 104 in the transfer message area 106 through a manual operation. This manual registration process routine is called from the step S19 of the main process routine.

In this manual registration process, it is checked whether or not an empty sector is present in the transfer message area 106 (Step S80). This is performed by checking whether or not the memory area set to "0" is present in the transfer message sector management area 105, by an amount of sectors occupied by the normal messages to be transferred.

If it is determined that the empty sector is present, a sector number of the empty sector is obtained. Next, the sector number obtained at the step S80 is again registered on the message file data area 102 (Step S81). Next, the message file management area 101 is updated (Step S82). That is, "1" is set in a memory area corresponding to a message file number of an entry on which the sector number is registered.

Next, the normal message is transferred to the transfer message area 106 (Step S83). That is, the normal message stored in the normal message area 104 is read out and then stored in a sector specified by the obtained sector number. Next, the normal message sector management area 103 is updated (Step S84). That is, a memory area of the normal message sector management area 103 corresponding to a sector number in which the normal message is stored is cleared to "0".

Next, the transfer message sector management area 105 is updated (Step S85). That is, "1" is set in a memory area of the transfer message sector management area 105 corresponding to the obtained sector number. Next, the transferred normal message is cleared (Step S86). After that, the control returns from the manual registration process routine to the step S11 of the main process routine.

If it is determined at the step S80 that the empty sector is not present in the transfer message area 106, it is next checked that the empty sector is present in the normal message area 104 (Step S87). If it is determined that the empty sector is not present, the registering process is stopped (Step S88). After that, the control returns from the manual registration process routine to the step S11 of the main process routine.

On the other hand, if it is determined that the empty sector is present, a flag of a corresponding entry in the message file information is set in order to change the normal message into the transfer message (Step S89). After that, the control returns from the manual registration process routine to the step S11 of the main process routine.

Though the execution of the above-mentioned processes enables the message stored in the normal message area 104 to be transferred to the transfer message area 106 as the transfer message. Thus, it is possible to transfer the message to the personal computer PC. Therefore, the normal message, which is not desired to be discarded is possible to store therein the message.

In the above-mentioned embodiment, the transfer message is accumulated in the transfer message area 106, and when the personal computer PC is connected to the external terminal 9, the transfer message is transferred to the personal computer PC. However, when the personal computer PC is always connected to the external terminal 9, the received transfer message may be transferred to the personal computer PC while maintaining its original state. According to this configuration, the message capacity checking process is not required. Moreover, the capacity of the transfer message area 106 can be reduced by a large margin.

As described above, according to the selective call radio receiver having the external terminal function of the present invention, when the amount of messages stored in the transfer message memory reaches the predetermined amount, the user is warned of the transfer of the content of the transfer message memory to the personal computer PC, by using the singing tone from the speaker and the display on the LCD. The user can cope with that warning and carry out the predetermined operation to transfer the content of the transfer message memory to the personal computer PC. Accordingly, it is possible to prevent the message stored in the message memory from being discarded before the user reads it.

Moreover, the transfer message memory dedicated to the message to be transferred to the external unit is provided. Thus, even the reception of the normal message which is not transferred to the external unit has no influence on the content of the transfer message memory. Also, the message memory for storing therein the message to be transferred to the personal computer PC is reserved in advance, and the received message is stored in the message memory. Therefore, it is not necessary to select the message to be transferred from the side of the personal computer PC.

As detailed above, the present invention can provide the selective call radio receiver having the external connection function which can prevent the message having the old reception time from being discarded.

What is claimed is:

1. A selective call radio receiver with an external connection function, comprising a connection section to which an external unit is connected;

a normal message storage section for storing normal messages;

a transfer message storage section for storing transfer messages;

a control section for classifying a reception message into said normal message and said transfer message based on a header data of said reception message to store in one of said normal message storage section and said transfer message storage section in accordance with the classification, and for transferring said transfer message from said transfer message storage section to said external unit through said connection section in response to a transfer instruction; and an output section for outputting an alarm in response to an alarm instruction wherein said control section checks a usage ratio of said transfer message storage section, and output said alarm instruction to said output section, when said usage ratio is equal to or more than a predetermined value.

2. A selective call radio receiver according to claim 1, wherein said output section outputs the alarm in at least one of sound and display.

3. A selective call radio receiver according to claim 1, wherein said control section checks said usage ratio of said transfer message storage section for every predetermined time.

4. A selective call radio receiver according to claim 1, wherein said control section further clears said transfer message storage section in response to an clear instruction.

5. A selective call radio receiver according to claim 1, further comprising a connection switch for checking whether said external unit is connected and for generating said transfer instruction when it is determined that said external unit is connected.

6. A selective call radio receiver according to claim 1, wherein said selective call radio receiver has a plurality of identifiers, and wherein said control section determines whether said reception message is said normal message or said transfer message, based on a destination identifier contained in said header data of said reception message and said plurality of identifiers.

7. A selective call radio receiver according to claim 1, wherein said control section checks whether said transfer message storage section is full, and stores said transfer message in said normal message storage section, when it is determined that said transfer message storage section is full.

8. A selective call radio receiver according to claim 1, wherein said control section moves said transfer message stored in said normal message storage section into said transfer message storage section in response to a movement instruction.

9. A selective call radio receiver according to claim 1, wherein said control section stores said transfer messages in said transfer message storage section in order of reception, and when a portion of said transfer messages stored in said transfer message storage section is cleared, said control section squeezes remaining transfer messages in said transfer message storage section.

10. A method of transferring a transfer message to an external unit in a selective call radio receiver, comprising:

classifying a reception message into a normal message and a transfer message based on a header data of said reception message to store in one of a normal message storage section and a transfer message storage section in accordance with the classification;

transferring said transfer message from said transfer message storage section to said external unit, which is connected to said selective call radio receiver, in response to a transfer instruction;

checking a usage ratio of said transfer message storage section, to generate an alarm instructions when said usage ratio is equal to or more than a predetermined value; and outputting an alarm in response to said alarm instruction.

11. A method according to claim 9, wherein said outputting step includes outputting the alarm in at least one of sound and display.

12. A method according to claim 9, wherein said checking step includes checking said usage ratio of said transfer message storage section for every predetermined time.

13. A method according to claim 10, further comprising:

clearing said transfer message storage section in response to an clear instruction.

14. A method according to claim 10, wherein said clearing step includes:

checking whether said external unit is connected; and generating said transfer instruction when it is determined that said external unit is connected.

15. A method according to claim 10, wherein said selective call radio receiver has a plurality of identifiers, and wherein said classifying step includes determining whether said reception message is said normal message or said transfer message, based on a destination identifier contained in said header data of said reception message and said plurality of identifiers.

16. A method according to claim 10, wherein said classifying step includes:

checking whether said transfer message storage section is full; and storing said transfer message in said normal message storage section, when it is determined that said transfer message storage section is full.

17. A method according to claim 10, wherein said transferring step includes transferring said transfer message stored in said normal message storage section into said transfer message storage section in response to a movement instruction.

18. A method according to claim 10, wherein said classifying step includes storing said transfer messages in said transfer message storage section in order of reception, and wherein said transferring step includes, when a portion of said transfer messages stored in said transfer message storage section is cleared, squeezing remaining transfer messages in said transfer message storage section.

* * * * *